US010655319B1

(12) United States Patent
Lauth

(10) Patent No.: US 10,655,319 B1
(45) Date of Patent: May 19, 2020

(54) DRAIN AUGER ENCASEMENT AND DRAIN AUGER INCLUDING THE SAME

(71) Applicant: Robert A. Lauth, Northport, NY (US)

(72) Inventor: Robert A. Lauth, Northport, NY (US)

( * ) Notice: Subject to any disclaimer, the term of this patent is extended or adjusted under 35 U.S.C. 154(b) by 0 days.

(21) Appl. No.: 16/230,757

(22) Filed: Dec. 21, 2018

(51) Int. Cl.
*E03F 9/00* (2006.01)

(52) U.S. Cl.
CPC ..... *E03F 9/005* (2013.01)

(58) Field of Classification Search
CPC .. B08B 9/02; B08B 9/027; B08B 9/04; B08B 9/043; B08B 9/0436; B08B 9/047; B08B 9/049; B08B 9/051; E03C 1/302; E03F 9/00; E03F 9/005
USPC ..... 15/104.095, 104.31, 104.33
See application file for complete search history.

(56) References Cited

U.S. PATENT DOCUMENTS 2,297,755 A * 10/1942 Faust ..... E03C 1/302 15/104.33
8,931,131 B1 * 1/2015 Feduke ..... E03F 9/002 134/6
9,637,909 B1 * 5/2017 Penny ..... E03C 1/302
10,240,330 B2 * 3/2019 Tisch ..... E03C 1/302

FOREIGN PATENT DOCUMENTS

CA 2961845 A1 * 10/2017 ..... E03C 1/302

* cited by examiner

*Primary Examiner* — Bryon P Gehman
(74) *Attorney, Agent, or Firm* — F. Chau & Associates, LLC

(57) ABSTRACT

A drain auger housing system includes a main body section for receiving a drain auger. A bottom chamber is disposed below the main body section. An inner base separates the main body section from the bottom chamber. The inner base is configured to support the drain auger and to permit a flow of fluid from the main body section to the bottom chamber. A clasping arrangement is disposed within the main body section and is configured to removably attach the drain auger housing to the drain auger. A foot platform or pedal is configured to release the drain auger from the clasping arrangement.

20 Claims, 5 Drawing Sheets

DRAIN AUGER ENCASEMENT AND DRAIN AUGER INCLUDING THE SAME

TECHNICAL FIELD

The present disclosure relates to drain augers and, more specifically, to drain auger encasements and drain augers including the encasements.

DISCUSSION OF THE RELATED ART

A drain auger, also known as a plumber's snake, is a flexible, retractable implement that may be extended along a drain pipe, for example, down a toilet bowl, to dislodge blockages that may be present within the drain pipe. The drain auger may have a coiled front end that may be rotated and used to twist its way into a blockage so that the blockage may be broken up or pulled clear.

While there are many different types of drain augers, most have a front end and a length of wire for extending the front end down a drain pipe. Some drain augers are extended manually while others are motorized. One particularly common type of drain auger is a toilet auger, also called a closet auger, which includes a relatively short length of wire that is fed though a hooked cane-shaped tubing. The hook shape makes it easier to feed the auger into the toilet while a plastic boot on the end of the tubing protects the porcelain of the toilet from being scratched.

As drain augers are commonly used to clear clogged toilet drains in institutional and corporate settings such as hospitals, office buildings, schools, etc., they may become contaminated while in use. After use, the toilet auger may be carried across the institutional setting to a maintenance room or some other storage location. This manner of transporting the toilet auger after use introduces the possibility of spreading contamination across an institutional setting, such as a hospital, where the need for a sanitary environment is particularly strong.

SUMMARY

A drain auger encasement/housing system includes a main body section for receiving a drain auger. A bottom chamber is disposed below the main body section. An inner base separates the main body section from the bottom chamber. The inner base is configured to support the drain auger and to permit a flow of fluid from the main body section to the bottom chamber. A clasping arrangement is disposed within the main body section and is configured to removably attach the drain auger encasement/housing to the drain auger. A foot platform or pedal is configured to release the drain auger from the clasping arrangement.

A cap may be disposed over a top surface of the encasement/housing. The cap may include a slot sized to receive the drain auger.

A plurality of wheels may be disposed on a lower section of the encasement/housing.

The foot platform or pedal may be arranged to at least partially cover one or more of the plurality of wheels.

A plurality of bristles may be disposed within the main body section.

The inner base may include a mesh or porous platform.

The inner base may be sloped.

An inlet port may be configured to receive a first hose and an outlet port may be configured to receive a second hose.

The foot platform or pedal may be configured to hold the drain auger encasement/housing system steady as a user pulls the drain auger free of the clasping arrangement.

The foot platform or pedal may be configured to mechanically release the drain auger from the clasping arrangement.

An encasement for a drain auger includes a first chamber having an opening in a top thereof. A second chamber is disposed below the first chamber. A porous platform separates the first chamber from the second chamber. One or more sidewalls of the first chamber are indented inwardly in a region of the first chamber disposed between the opening and the porous platform.

The first chamber may have a substantially cylindrical shape, a substantially prism shape, or a substantially pyramid shape.

The opening may be a slit formed within a rubber portion.

An inlet port may be disposed within the first chamber and an outlet port may be disposed within the second chamber.

The porous platform may be sloped and the slope may be at an angle of up to 45° from horizontal.

A support structure for receiving the drain auger may be disposed on the porous platform, within the first chamber.

The support structure may be configured to lock a portion of the drain auger within the first chamber.

An encasement for a drain auger includes a chamber configured to receive the drain auger. An opening is configured to permit insertion of the drain auger into the chamber. The chamber has at least one sloped wall configured to receive the drain auger and maintain the drain auger in an upright position and is further configured to create an external cavity and an exposed bottom platform under the external cavity such that the external cavity is sized to receive a foot of a user that is stepped down upon the exposed bottom platform.

The encasement may further include a clasping arrangement disposed within the chamber and configured to apply friction pressure to the drain auger when it is maintained within the chamber.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE DRAWINGS

Figure 1:
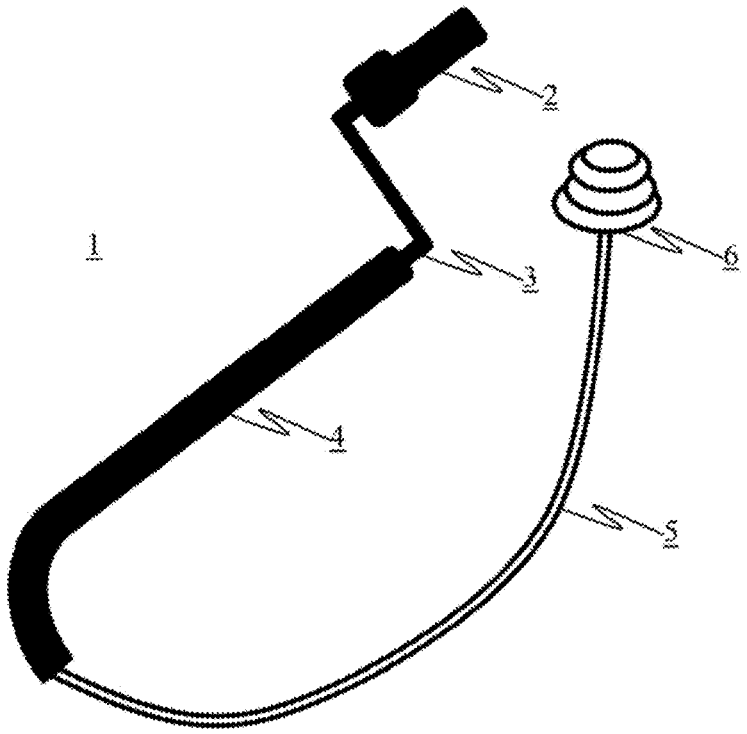
FIG. 1 is an example of a toilet auger that may be used in accordance with exemplary embodiments of the present invention.

In describing exemplary embodiments of the present disclosure illustrated in the drawings, specific terminology is employed for sake of clarity. However, the present disclosure is not intended to be limited to the specific terminology so selected, and it is to be understood that each specific element includes all technical equivalents which operate in a similar manner.

Exemplary embodiments of the present invention provide an encasement and/or housing for a drain auger, such as a toiler auger, so that after the drain auger is used, it may be secured within the encasement/housing and transported while encased/housed so as to minimize contamination. It is to be understood, that as used herein, the phrase "encasement/housing" is meant to refer to an element that is considered either an encasement or at housing or is considered to be both an encasement and a housing, as these terms may be used interchangeably in the art.

FIG. 1 is a diagram illustrating an example of a toilet auger that may be used in accordance with exemplary embodiments of the present invention, although it is to be understood that exemplary embodiments of the present invention may also be applied to other types of drain augers. The toilet auger 1 may include a handle 2 that may be used to hold and direct the operation of the auger 1. The handle may be used to rotate a shaft 3 that may retract and extend a cable 5. A boot 4 may be used to guide the cable 5 and to protect porcelain surfaces of a toilet or other receptacle from scratching. An end unit 6, which may be made of spiraled wire, may be disposed at the end of the cable 5. The end unit 6 may be used to twist through and then to catch drain clogs so that they may be removed.

Figure 2:
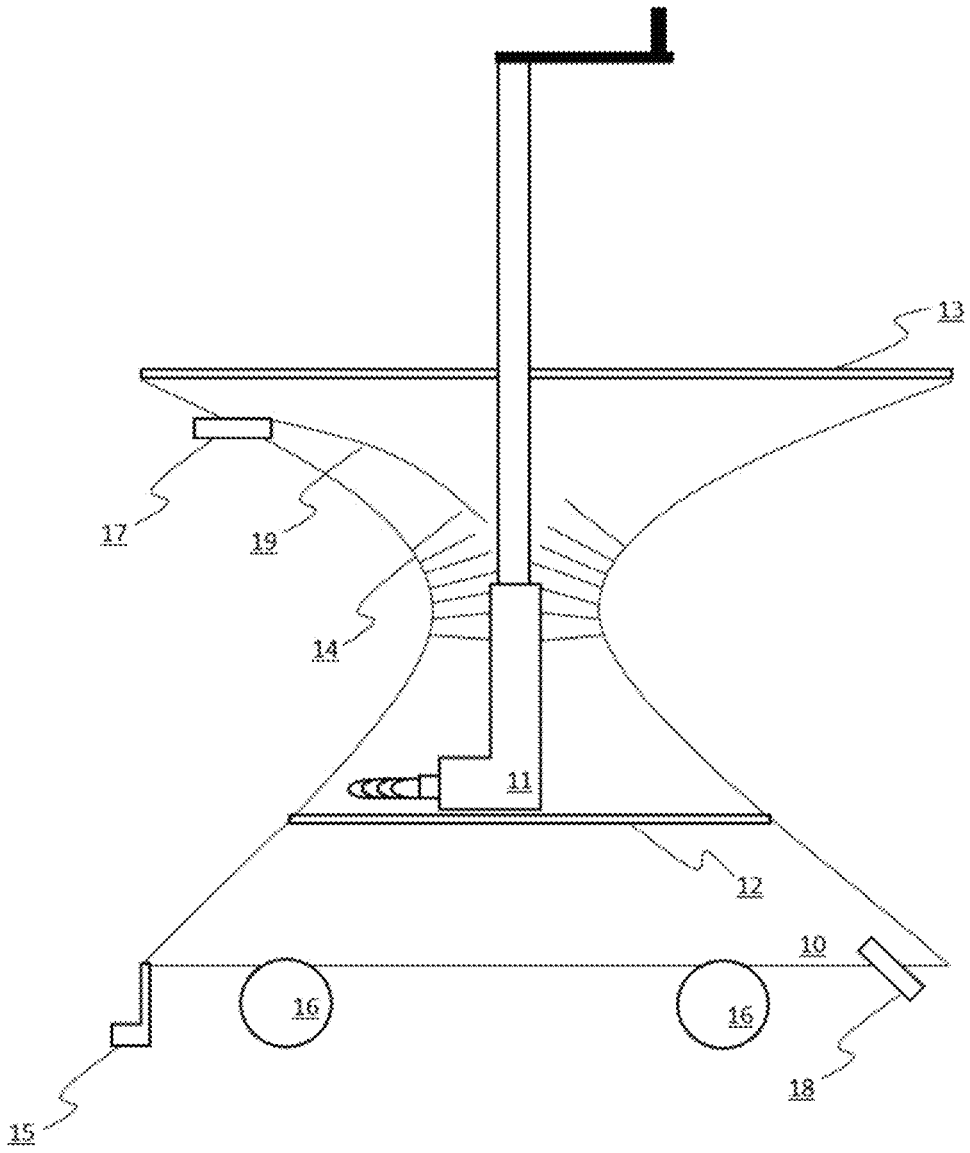
FIG. 2 is a cut-away of a drain auger encasement/housing in accordance with exemplary embodiments of the present invention.

After use, the auger 1 may be inserted into an encasement or housing to prevent contamination as the auger 1 is transported. FIG. 2 is a cut-away view of a drain auger encasement/housing in accordance with exemplary embodiments of the present invention. The encasement/housing 10, in accordance with exemplary embodiments of the present invention, may define an interior cavity for receiving the drain auger 11. The cavity may have a cap 13 disposed thereon that is configured to receive the drain auger and to prevent any splattering of waste that may be introduced to the interior of the cavity by the introduction of the drain auger 11. The cavity may contain an inner base platform 12 therein. The inner base platform 12 may be formed of a mesh or screen and may be configured to allow the drain auger 11 to rest upon its surface while permitting waste and other liquids to pass through the inner base down to a bottom chamber, which is defined as the portion of the cavity that resides below the inner base platform 12. The cavity may thereby contain the waste therein without having the drain auger 11 sitting in the waste and other liquids while at rest within the encasement/housing 10.

The cavity may also contain a clasping arrangement 14 that applies friction to the auger 11 so as to keep it in place during transportation. The clasping arrangement 14 may include a narrowing so as to pinch the drain auger 11 into place, so that when the drain auger 11 is carried away or otherwise transported, the drain auger encasement/housing 10 remains firmly affixed to the drain auger 11.

One or more foot platforms or pedal 15 may be affixed to a bottom of the encasement/housing 10. These structures may extend from the encasement/housing 10 and define a flat region that is substantially parallel to and in contact with the floor of the facility that the encasement/housing 10 is present within. This flat region of the foot platforms or pedal 15 may be configured to allow a user to step upon it when removing the drain auger 11 from the encasement/housing 10. By stepping on the foot platforms or pedal 15, the encasement/housing 10 may be held to the floor as the user pulls up on the drain auger 11 to overcome the friction of the clasping arrangement 14.

The foot platform/pedal 15 may either mechanically release the drain auger 11 from the clasping arrangement 14, by activating an unlocking mechanism, or may simply provide a convenient area for the user to step on while pulling up on the drain auger and overcoming the friction of the clasping arrangement 14.

The cap 13 of the encasement/housing 10 may include an opening though which the drain auger 11 may be inserted and removed. The cap 13 may at least partially cover a top surface of the encasement/housing 10 so as to prevent contents therein from escaping during transportation or insertion/removal of the drain auger 11, such as by splattering.

The drain auger 11 may come to rest on the inner base platform 12, which may include a mesh or other porous structure, as discussed above. The inner base platform 12 may be substantially horizontal, as shown, or may be angled to better allow waste to come away from the drain auger 11, once in place and to settle within the bottom chamber of the encasement/housing 10. Where the inner base platformed is angled, it may be sloped with respect to a horizontal plane of the floor. For example, the inner base platform may be sloped at up to 45° from horizontal.

As discussed above, the clasping arrangement 14 may be configured to apply friction force to the drain auger 11 so as to keep it in place during transportation. The clasping arrangement 14 may include an inward bowing of the sidewalls of the encasement/housing 10, as shown, so as to create a narrowing or neck within the encasement/housing 10. The clasping arrangement may additionally include a liner with flexible plastic bristles extending from the interior of the narrowing/neck, which may be used to increase locking friction, to better prevent the splattering of contaminants, and to clean the drain auger 11 as it is inserted into the encasement/housing 10 or removed therefrom.

The clasping arrangement 14 may allow for the encasement/housing 10 to remain securely coupled to the drain auger 11 as the drain auger 11 is carried away. Accordingly, as the user lifts and caries away the drain auger 11, the encasement/housing 10 may be similarly lifted and carried away.

However, according to some exemplary embodiments of the present invention, the clasping arrangement 14 may further include a mechanical restraint system which may mechanically engage with the drain auger so as to provide added support for keeping the encasement/housing 10 affixed to the drain auger 11 while being moved.

To remove the drain auger 11 from the encasement/housing 10, a user may step upon a foot platform or pedal 15 while pulling up on the drain auger 11 to overcome the friction associated with the clasping arrangement 14. However, where the clasping arrangement includes a mechanical restraint system, engaging the foot platform or pedal 15 may mechanically release/unlock the mechanical restraint system so as to allow for the removal of the drain auger 11.

The clasping arrangement 14 may further include a key lock so that a key may be used to lock the drain auger 11 in place within the encasement/housing 10 and to unlock it therefrom so as to prevent use by an unauthorized individual who may not be inclined to follow proper protocol to minimize contamination.

One or more wheels 16 may be disposed on a bottom of the encasement/housing 10. The foot platform or pedal 15 may extend down substantially to the floor to allow for easier stepping but may still not make contact with the floor so as not to impede the encasement/housing 10 from being rolled on its wheels 16. Alternatively, the foot platform/pedal 15 may make contact with the floor and may include a glider or other low friction pad so that the encasement/housing 10 may be easily transported from room to room.

Moreover, the foot platform or pedal 15 may be formed around the wheels 16 so as to cover and protect the wheels 16. The foot platform or pedal 15 may be at least partially bendable so that when it is stepped on, it may be easily pressed against the ground and so the foot platform or pedal 15 may be resistant to cracking in the event of impact.

The wheels 16 may be caster wheels that may be free to rotate and roll in any direction. There may be 3 or 4 wheels 16, or any other number of wheels, for that matter. The wheels 16 may permit the encasement/housing 10 to be easily rolled away, especially once the drain auger 11 is locked within the encasement/housing 10.

The encasement/housing 10 may be cleaned when not in use so as to clear the interior surfaces of contamination. Cleaning may be facilitated by the inclusion of an inlet port 17 and an outlet port 18. The inlet port 17 may include a hose connector so that a water hose may be screwed into place. Water may flow though the hose and enter the encasement/housing 10 via the inlet port 17. The water may then flush the interior surfaces of the encasement/housing 10 and may then exit thought the outlet port 18. This flushing procedure may also be performed, while the drain auger 11 is inserted within the encasement/housing 10, to clean the drain auger along with the inner surfaces of the encasement/housing 10. The outlet port 18 may also include a hose connector so as to attach a drain hose thereto. When not in use, the inlet port 17 and/or the outlet port 18 may be plugged with a rubber stopper or have a cap screwed thereon.

The cap 13 of the encasement/housing 10 may provide a sufficiently water-tight closure so as to prevent the flushing water from spilling out of the cap regardless of whether the drain auger 11 is inside the encasement/housing 10. Additionally, a baffle 19 may be disposed within the encasement/housing 10 so as to direct incoming water away from the cap 13 so as to further reduce the risk of splashing.

During cleaning, the cap 13 may be removed from the encasement/housing so as to allow access into the encasement/housing 10 for cleaning. Additionally, the cap 13, which includes an opening for receiving the drain auger 11, may be replaced with a sealing cap, not having such an opening, so that water may be prevented from leaving through the top opening of the encasement/housing 10. When such a cleaning cap is used, the water may be provided to the encasement/housing 10 with relatively high pressure so as to better clean all interior surfaces of the encasement/housing, without water exiting from anywhere but the outlet port. Both the cap 13 and the sealing cap may be attached to the encasement/housing 10 either by friction or by screwing in, snapping in, etc. and to facilitate this, the top opening of the encasement/housing 10 may have a rim, lip, or tread.

Figure 3:
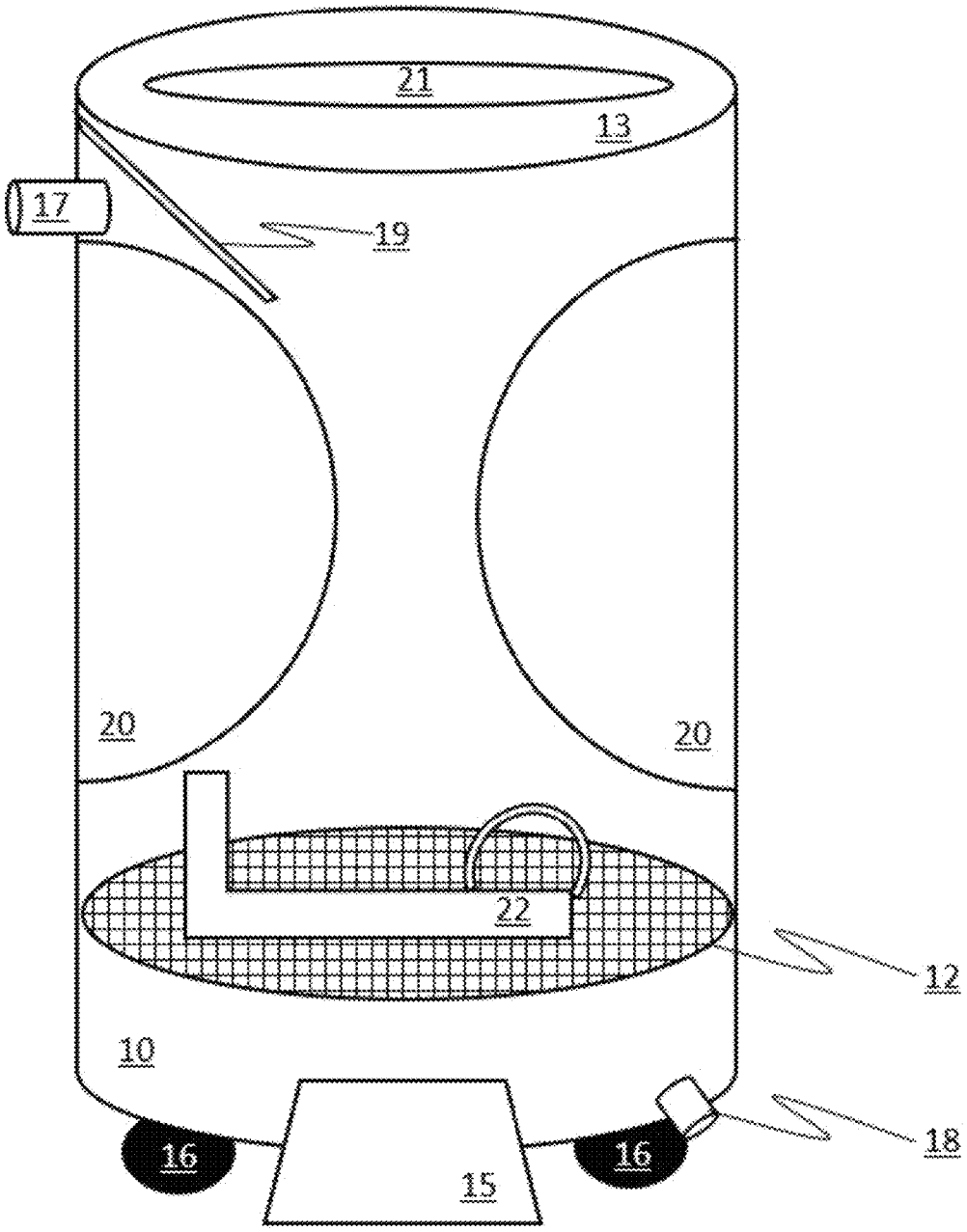
FIG. 3 is a perspective view of a drain auger encasement/housing in accordance with exemplary embodiments of the present invention.

FIG. 3 is a perspective cut-away view of a drain auger encasement/housing 10 in accordance with exemplary embodiments of the present invention. As can be seen from this figure, the encasement/housing 10 may include a narrowed portion that is formed from at least two portions of the sides of the encasement/housing 10 bending inwardly so as to press against the drain auger 11 when inserted therein. However, in FIG. 3, the drain auger 11 is not depicted so as to more clearly illustrate the structural aspects of the encasement/housing 10.

As can be seen from this figure, the cap 13 may include a slit 21. The slit may be formed within a rubber portion so that the slit may tent to remain closed when not in use and so as to close tightly around the auger when inserted therein. The slit may tend to remain sealed when the drain auger 11 is not inserted therethrough, but may open readily up as the drain auger 11 is inserted.

The drain auger 11 may come to rest either directly on the inner base platform 12 or may rest upon a support structure 22 configured to receive the drain auger 11. The support structure 22 may either be a contoured structure for securely receiving the drain auger 11, or the support structure may be part of the aforementioned mechanical restraint system, in which case it may be configured to mechanically engage with the drain auger 11. It is to be noted that the support structure 22 is illustrated having an arbitrary shape, however, the support structure 22 is not necessarily limited to the shape shown. The support structure 22 may have any shape suitable to receive, and in some cases, engage with the drain auger 11. For example, the support structure 22 may include a loop (as shown) to receive the boot of the auger 11 so that as the auger is pulled up, the loop may help to secure the auger 11 to the encasement/housing 10 without the auger 11 pulling out of the encasement/housing 10. In this case, the auger 11 may be removed by tilting the boot to withdraw it from the loop.

It is also noted that while there is only one foot platform or pedal 15 shown, there may be multiple foot platforms or pedals 15, for example, there may be one foot platform or pedal 15 disposed over each wheel 16.

While FIG. 3 does not show the use of bristles within the clasping arrangement 14, it is noted that exemplary embodiments of the present invention may either include or omit this feature. However in the embodiment shown, the clasping arrangement 14 is formed by two or more depressions 20 that may exist within an otherwise cylindrical encasement/housing 10.

Moreover, while exemplary embodiments of the present invention have been illustrated herein as including a substantially cylindrical encasement/housing 10 having at least two concave sides, such as an hourglass shape, exemplary embodiments of the present invention are not limited to this approach. The encasement/housing may have any desired shape. For example, the encasement/housing may have a substantially rectangular shape or a substantially triangular shape.

Figure 4:
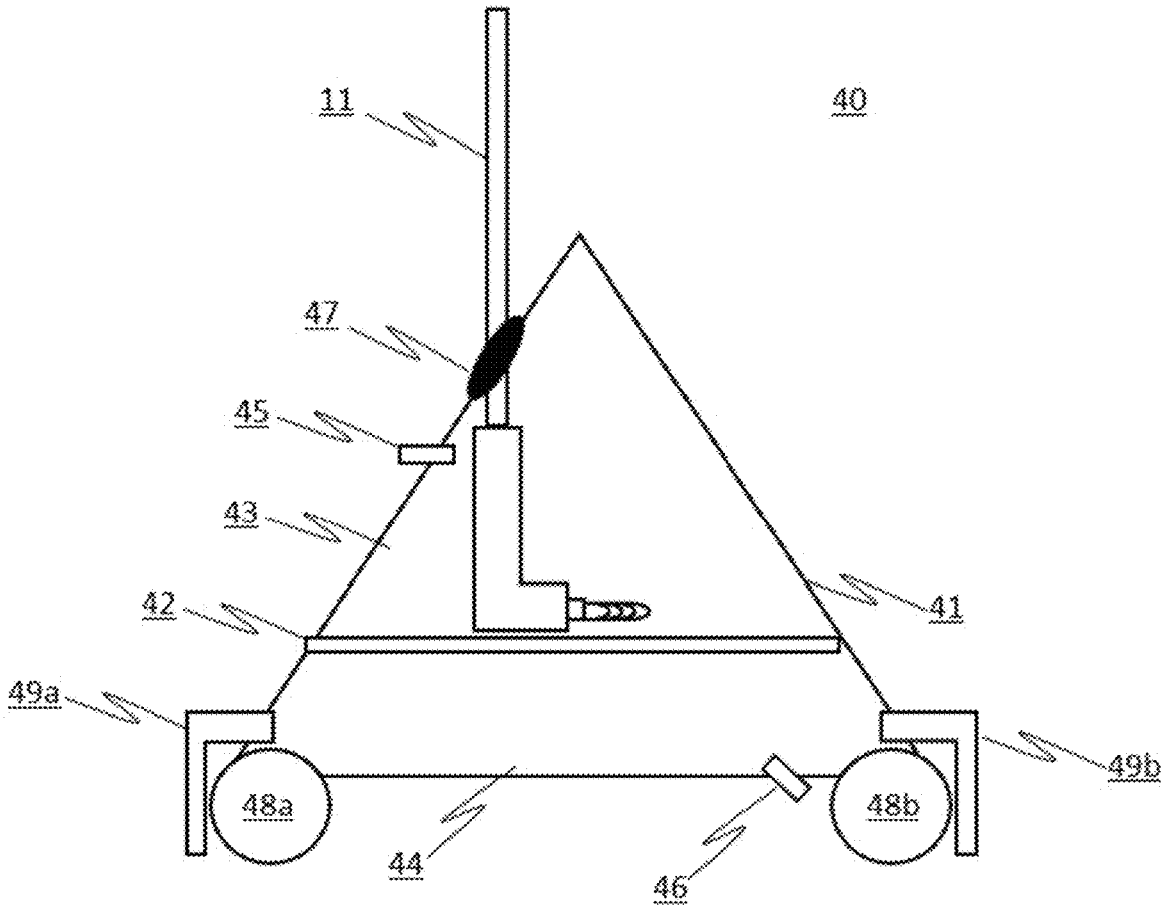
FIG. 4 is a cut-away view illustrating a drain auger encasement/housing having a substantially triangular shape in accordance with exemplary embodiments of the present invention.

FIG. 4 is a cut-away view illustrating a drain auger 11 encasement/housing 10 having a substantially triangular shape in accordance with exemplary embodiments of the present invention.

It is also noted that in the arrangement of FIG. 4, the cap 47 is disposed on a first side surface 43 of the encasement/housing, rather than on a top surface thereof. A second side surface 41 may be arranged opposite to the first side surface 43. The first and second side surfaces 43 and 41 may each be triangular panels. There may also be third and fourth side surfaces that are similarly arranged so as to give the encasement/housing a substantially pyramid shape. Alternatively, the first and second side surfaces 43 and 41 may each be rectangular while the third and fourth side surfaces (not shown) are triangular to give the encasement/housing a substantially prism shape.

The shape of the encasement/housing help to further protect against leakage, both in use and during cleaning. The triangular arrangement may also serve to act as a warning sign to help people to easily become aware that there is an active maintenance operation underway and that care should be used in approaching.

An inlet port 45 may be disposed on one of the side surfaces such as the first side surface 43 (as shown). The outlet port 46 may be disposed on a bottom platform 44 of the encasement/housing so as to provide better drainage. An inner base platform 42 may provide a support surface for the auger 11 so that the auger does not rest in liquids and other contamination that may accumulate within the encasement/housing.

Two wheels 48*a* and 48*b* are shown by way of example, however, as the bottom platform 44 of the encasement/housing may have a rectangular shape, four wheels may be used. As depicted herein, two platforms/pedals 48*a* and 48*b* may be disposed around each wheel and these structures may be configured to receive the user's foot thereupon. However, in this case, the user would step on the top surface of the platforms/pedals 48*a* and 48*b* so that the platforms/pedals 48*a* and 48*b* need not be pressed against the floor.

Figure 5:
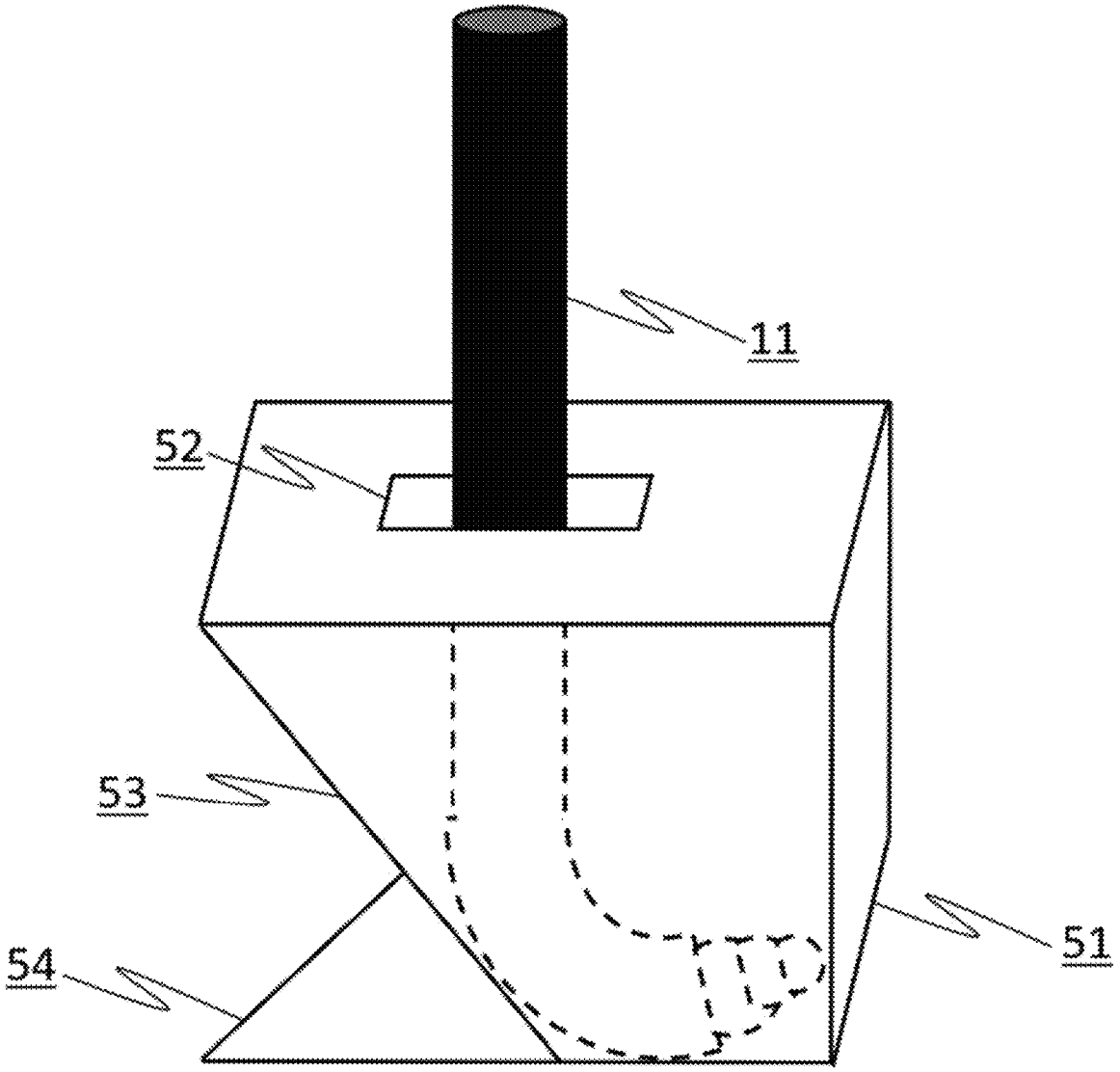
FIG. 5 is a perspective view illustrating a drain auger encasement/housing having a tapered bottom forming a foot platform in accordance with exemplary embodiments of the present invention.

FIG. 5 is a perspective diagram illustrating an arrangement of a drain auger 11 and an encasement/housing 5 in accordance with exemplary embodiments of the present invention. The boot of the drain auger 11 is shown and a part of the drain auger 11 that is within the encasement/housing 51 is shown by dotted lines, including a spiraled wire end unit thereof. Here, the encasement/housing 51 is shown as having a substantially cuboid shape with one corner thereof having been removed. By removing the corner, a slanted side surface 53 is created to accommodate the boot of the drain auger 11. Additionally, by removing the corner, while retaining the entire rectangular bottom surface of the encasement/housing 51, a stepping platform 54 may be exposed to facilitate removal of the drain auger 11. The encasement/housing 51 may further include an opening 52 disposed on a top surface thereof through which the drain auger 11 may be inserted and removed. By using a simple opening, rather than a cap, the costs associated with producing the encasement/housing 51 may be minimized. Additionally, as the stepping platform 54 is realized from an exposed portion of the base of the encasement/housing 51, no separate platforms or pedal 15 need be affixed to the encasement/housing 51, thereby further reducing manufacturing costs.

However, it is to be understood that any of the features of any of the encasements/housings described herein and shown in the drawings may be mixed and matched and it is to be understood that every feature shown may be optimally included and combined with any other feature shown. The particular combination of features shown are illustrated merely for the purpose of providing a convenient set of illustrations.

Exemplary embodiments described herein are illustrative, and many variations can be introduced without departing from the spirit of the disclosure. For example, elements and/or features of different exemplary embodiments may be combined with each other and/or substituted for each other within the scope of this disclosure.

What is claimed is:

1. A drain auger housing system, comprising:

a main body section for receiving a drain auger;

a bottom chamber disposed below the main body section;

an inner base separating the main body section from the bottom chamber, the inner base being configured to support the drain auger and to permit a flow of fluid from the main body section to the bottom chamber;

a clasping arrangement disposed within the main body section and configured to removably attach the drain auger housing to the drain auger; and a foot platform or pedal configured to release the drain auger from the clasping arrangement.

2. The system of claim 1, further including a cap disposed over a top surface of the housing, the cap including a slot sized to receive the drain auger.

3. The system of claim 1, further including a plurality of wheels disposed on a lower section of the housing.

4. The system of claim 3, wherein the foot platform or pedal is arranged to at least partially cover one or more of the plurality of wheels.

5. The system of claim 1, wherein a plurality of bristles is disposed within the main body section.

6. The system of claim 1, wherein the inner base includes a mesh or porous platform.

7. The system of claim 1, wherein the inner base is sloped.

8. The system of claim 1, further including an inlet port configured to receive a first hose and an outlet port configured to receive a second hose.

9. The system of claim 1, wherein the foot platform or pedal is configured to hold the drain auger housing system steady as a user pulls the drain auger free of the clasping arrangement.

10. The system of claim 1, wherein the foot platform or pedal is configured to mechanically release the drain auger from the clasping arrangement.

11. An encasement for a drain auger, comprising:

a first chamber having an opening in a top thereof;

a second chamber disposed below the first chamber; and a porous platform separating the first chamber from the second chamber, wherein one or more sidewalls of the first chamber are indented inwardly in a region of the first chamber disposed between the opening and the porous platform.

12. The encasement of claim 11, wherein the first chamber has one of a substantially cylindrical shape, a substantially prism shape, and a substantially pyramid shape.

13. The encasement of claim 11, wherein the opening is a slit formed within a rubber portion.

14. The encasement of claim 11, wherein an inlet port is disposed within the first chamber and an outlet port is disposed within the second chamber.

15. The encasement of claim 11, wherein the porous platform is sloped.

16. The encasement of claim 11, wherein the porous platform is sloped at an angle of up to 45° from horizontal.

17. The encasement of claim 11, wherein a support structure for receiving the drain auger is disposed on the porous platform, within the first chamber.

18. The encasement of claim 17, wherein the support structure is configured to lock a portion of the drain auger within the first chamber.

19. An encasement for a drain auger, comprising:

a chamber configured to receive the drain auger; and an opening configured to permit insertion of the drain auger into the chamber, wherein the chamber has at least one sloped wall configured to receive the drain auger and maintain the drain auger in an upright position, wherein the at least one sloped wall defines an external cavity; and wherein the at least one sloped wall further defines an exposed bottom platform under the external cavity.

20. The encasement of claim 19, further comprising a clasping arrangement disposed within the chamber and configured to apply friction pressure to the drain auger when it is maintained within the chamber.

* * * * *